US005105696A

United States Patent [19]

Baubles

[11] Patent Number: 5,105,696

[45] Date of Patent: Apr. 21, 1992

[54] METHOD AND APPARATUS FOR PUNCHING A CROSS HOLE

[75] Inventor: Richard C. Baubles, Maplewood, N.J.

[73] Assignee: Jacobson Mfg. Co., Inc., Kenilworth, N.J.

[21] Appl. No.: 624,634

[22] Filed: Dec. 10, 1990

[51] Int. Cl.[5] ..... B26D 11/00; B26F 1/02

[52] U.S. Cl. ..... 83/35; 83/50; 83/55; 83/255; 83/405

[58] Field of Search ..... 83/13, 35, 39, 50, 51, 83/55, 255, 256, 405

[56] References Cited

U.S. PATENT DOCUMENTS

| | | | |
|---|---|---|---|
| 2,371,734 | 3/1945 | Buttress | 83/51 |
| 2,419,862 | 4/1947 | Wales . | |
| 2,508,758 | 5/1950 | Hollerith | 83/51 |
| 3,232,156 | 2/1966 | Fuller . | |
| 3,566,513 | 3/1971 | Fuller . | |
| 4,477,537 | 10/1984 | Blase et al. | 83/55 |

FOREIGN PATENT DOCUMENTS

| | | | |
|---|---|---|---|
| 7233340 | 4/1932 | France | 83/50 |
| 44392 | 3/1917 | Sweden | 83/55 |
| 1171154 | 8/1985 | U.S.S.R. | 83/124 |
| 1007418 | 10/1965 | United Kingdom | 83/13 |

*Primary Examiner*—Hien H. Phan

*Attorney, Agent, or Firm*—Richard L. Cannaday; Frank J. DeRosa

[57] ABSTRACT

A method and apparatus are disclosed for punching a cross hole in a workpiece with minimal or no distortion of the hole and the workpiece. According to the method, a cross hole of a given diameter is punched in a workpiece by punching a first hole having a diameter less than the given diameter in the workpiece from a first side thereof, and then punching the first hole again but from a second side of the workpiece opposite the first side at nominally the given diameter to produce the cross hole having the given diameter.

18 Claims, 1 Drawing Sheet

METHOD AND APPARATUS FOR PUNCHING A CROSS HOLE

BACKGROUND OF THE INVENTION

The invention disclosed herein relates to punching holes in workpieces with minimal or no distortion. The invention relates particularly to punching cross holes in relatively thin cross sections and/or relatively soft workpieces.

A cross hole, i.e., a hole which has its axis perpendicular to the major surfaces of the workpiece in which it is formed, may be made by drilling or punching. Drilling produces a hole with minimal distortion; that is, it produces a relatively straight hole and with minimal or no distortion of the workpiece, but drilling is a relatively slow and expensive operation. Where a burr-free hole is desired, it is common practice to drill part way through the workpiece from one side, and finish the hole by drilling from the other side, which makes the drilling operation even slower and more expensive.

A punched hole may be made much faster, and primarily for that reason is less expensive than a drilled hole. However, punching produces a hole with more distortion than a drilled hole, and also frequently distorts the workpiece. A punched hole may be made using a punch having the nominal size of the hole, and a die, which supports the workpiece being punched, having a slightly larger diameter hole than the diameter of the punch to permit removal of the punched-out material. For thinner metal workpieces, the die hole is just slightly larger than the punch, but the die hole is made progressively larger as the metal workpiece thickness increases in order to punch a clean hole without laps or tears As a result, a hole punched in a thicker workpiece is tapered rather than straight because it has the punch diameter at the punch side and the larger die hole diameter at the support side. In addition, the workpiece is frequently permanently bent during the punching operation by a moment generated in the workpiece as a result of the difference in diameters between the punch and the die hole. The bending effect is most pronounced when the workpiece width (distance from the edge of the workpiece to the hole) is small compared to the hole diameter, or when the workpiece is made of a soft material.

If a less distorted, e.g., straighter, punched hole be desired a two-diameter punch and shave procedure is commonly used. That procedure utilizes two punches of different diameters. The first punch and the die hole used therewith have normal diameters for the hole being punched, and produce the tapered hole described above. Because the second punch is used to remove or "shave" relatively little material, the second punch has a larger diameter than the diameter of the first punch, and the diameters of the second punch and the die hole used therewith are closer to each other than for the first punch and die hole. While that two diameter punch and shave procedure produces straighter holes, the workpiece bending described above still occurs.

In conventional cross hole punching operations, the die hole diameter is greater than the punch diameter by some percentage of the material thickness. The actual percentage varies depending upon the material and its hardness, and is typically about 10% of the material thickness For example, for a material thickness of about 0.150 inch, and a nominal desired cross hole of 0.200 inch, the punch diameter would be about 0.200 inch and the die hole diameter would be about 0.230 inch. For a shaving operation, the die hole diameter would exceed the punch diameter by only a few thousandths of an inch, e.g., the punch diameter would be about 0.200 inch and the die hole diameter about 0.205 inch.

There is, therefore, a need for a method and apparatus for producing low distortion holes at low cost, without distorting the workpiece, using punching as opposed to drilling.

SUMMARY OF THE INVENTION

It is an object of the invention disclosed herein to produce low distortion holes in workpieces less expensively.

It is another object of the invention to produce low distortion holes in workpieces less expensively without distorting the workpiece.

It is another object of the invention to produce such holes in workpieces by punching.

The above and other objects are achieved in accordance with the invention by punching a workpiece using different diameter punches to reduce or eliminate hole distortion such as tapering, and from opposite sides to reduce or eliminate workpiece distortion.

Workpiece bending is reduced or eliminated because bending resulting from punching from a first side of the workpiece is compensated by the punching from a second, opposite side of the workpiece.

A method, according to the invention, of punching a cross hole of a given diameter in a workpiece comprises supporting the workpiece and punching a first hole having a diameter less than the given diameter in the workpiece from a first side thereof, and supporting the workpiece and punching the first hole again but from a second side of the workpiece opposite the first side at the given diameter to produce the cross hole having the given diameter. Either the punching apparatus which drives punches into the workpiece is moved so as to act on opposite sides of the workpiece, or the workpiece is reversed or turned relative to the punching apparatus, i.e., the workpiece and the punching apparatus are moved relative to each other so as to punch opposite sides of the workpiece. Preferably, the workpiece is turned from one side to the other relative to the punching apparatus after the first hole is punched from the first side, and before the first hole is punched again from the second side.

The punching apparatus comprises first and second means for punching, e.g., first and second punches, means for supporting the workpiece during punching thereof and means for relatively moving the punching means and the workpiece to cause the punching means to punch through the workpiece. In the preferred embodiment, first and second punches are used, and the second punch has a diameter greater than that of the first punch and is sized to produce the cross hole having the given diameter.

The means for supporting the workpiece typically comprises a die. The die has a die hole which has a size greater than that of the corresponding punch, and which is selected, for each punching operation, in accordance with whether the hole is being punched the first time or being punched again, the size of the punch being used in the particular punching operation, and the thickness of the workpiece.

Unlike conventional cross hole punching operations, the diameter of the first punch is somewhat smaller than the nominal desired hole size, and the diameter of the first die hole is about the nominal desired hole size. The diameter of the second punch is about the nominal desired hole size, and the diameter of the second die hole is slightly larger than the diameter of the second punch.

The first punched hole produces a somewhat tapered hole, as indicated above. Because the second punch enters from the smaller side of the first punched hole, it tends to wipe material into the larger side so that the final hole is straighter than a normal shaved hole. The smaller the first punch, the more work the second punch has to do and the more the second punch "reforms" or rebends the workpiece. Thus, according to the invention, by punching the workpiece from opposite sides and by adjusting the relative sizes of the punches and die holes to compensate for material and shape variations, a hole with minimal or no distortion of the desired size may be obtained.

Apparatus in accordance with the invention for punching a cross hole of a given diameter in a workpiece, comprises the first punch and the second punch referred to above, the means for relatively moving the punch and the workpiece to cause the punches to be driven though the workpiece and withdrawn therefrom, the means for supporting the workpiece and the means for relatively turning the workpiece and the moving means so that the workpiece may be punched from opposite sides.

The punches and die holes have diameters as described above.

The means for relatively moving the punches and the workpiece relatively moves the first punch and the workpiece at a first time, and relatively moves the second punch and the workpiece at a second time, to cause the punches to first punch the lesser diameter hole, and then the hole of the given diameter. The means for relatively turning the workpiece and the moving means do so between the first and second times such that opposite sides of the workpiece are punched by the first and the second punches.

Preferably, the moving means moves the first and second punches towards and away from the workpiece to drive them through the workpiece and withdraw them, and the turning means turns the workpiece relative to the punch moving means and the supporting means.

BRIEF DESCRIPTION OF THE DRAWINGS

The invention is illustrated by way of example and not limitation in the figures of the accompanying drawings in which like references denote the same or corresponding parts, and in which.

DESCRIPTION OF THE PREFERRED EMBODIMENTS

Figure 1:
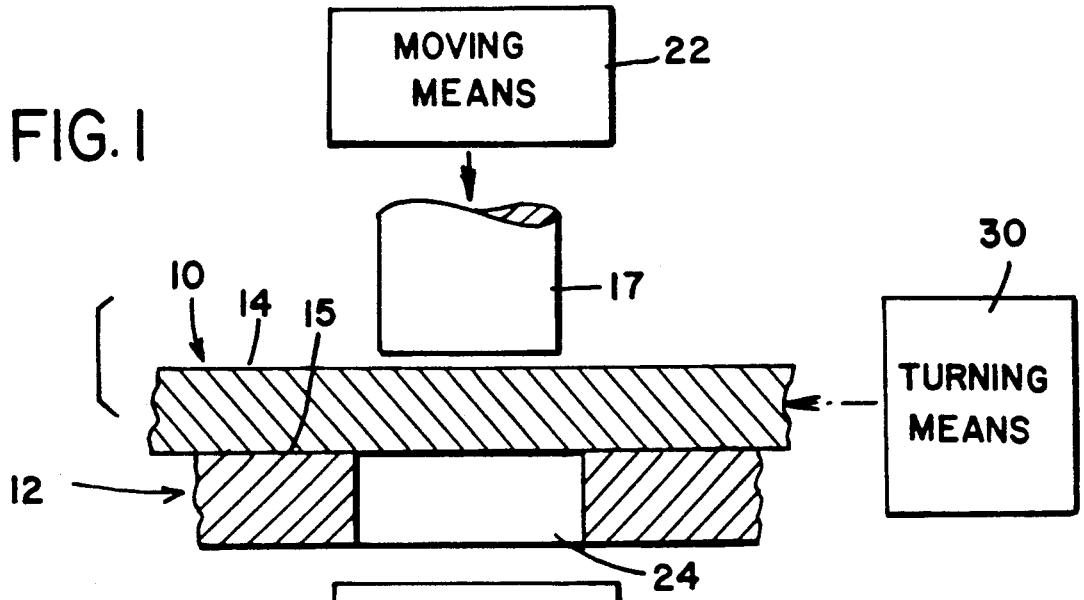
FIG. 1 is a schematic diagram in cross section showing a first punch, a die and a workpiece in position immediately prior to punching a first hole in the workpiece from a first side thereof.

Referring to the drawings, a workpiece 10 is supported by a die 12, 13 (supporting means) and punched from opposite sides 14, 15 thereof with first and second punches 17, 18, respectively, to produce a cross hole 20 (FIG. 3) of low distortion without distorting the workpiece.

Referring to FIG. 1, workpiece 10 is supported on die 12 between die 12 and first punch 17 ready to be punched by first punch 17. Punch 17 is driven by moving means 22 to drive punch 17 through workpiece 10 and then withdraw it. Such moving means are known to those of skill in the art and therefore are represented by a rectangular block. For example, moving means 22 may comprise respective holders for the first and second punches, means for indexing the holders to position the punches relative to the workpiece, and means for moving the respective punches toward and away from the workpiece to drive the respective punches therethrough and then withdraw them. First punch 17 has a diameter less than the desired finished diameter of the cross hole 20 (FIG. 3), and die 12 has a die hole 24 having a diameter larger than that of punch 17 and nominally equal to the desired diameter of cross hole 20. The relative diameters of punch 17 and die hole 24 are selected as described elsewhere herein. First punch 17 and die 12 are conventional except that the diameter of first punch 17 is typically less than that of a punch that would normally be used with die hole 24.

Figure 2:
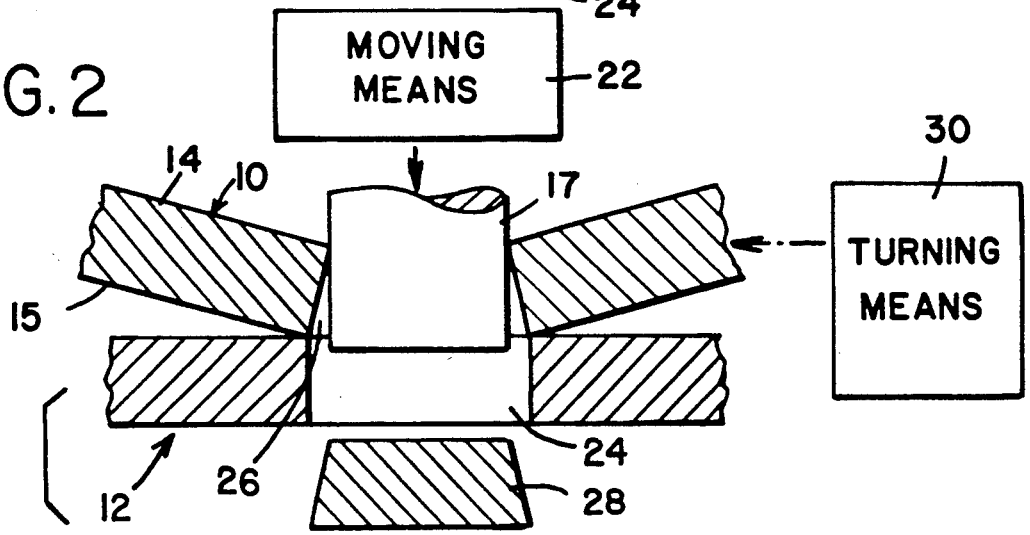
FIG. 2 is a diagram similar to that of FIG. 1 showing the first hole in the workpiece being punched from the first side.

Referring to FIG. 2, a first punching operation is performed in which first punch 17 is driven by moving means 22 through workpiece 17 from a first side 14 thereof to punch a first hole 26 therein having a diameter nominally equal to the diameter of first punch 17 but less than the final diameter desired for the cross hole. First punch 17 pushes the punched-out material 28 through the hole 24 of die 12. This first punching operation typically causes the workpiece, particularly a narrow width workpiece or one made of soft material, to bend under the moment generated in the workpiece as a result of the difference in diameters between first punch 17 and die hole 24. In wider or harder workpieces, less bending occurs, but the punched hole may be tapered as described above. FIG. 2 shows the bending in the workpiece exaggerated for effect.

Figure 3:
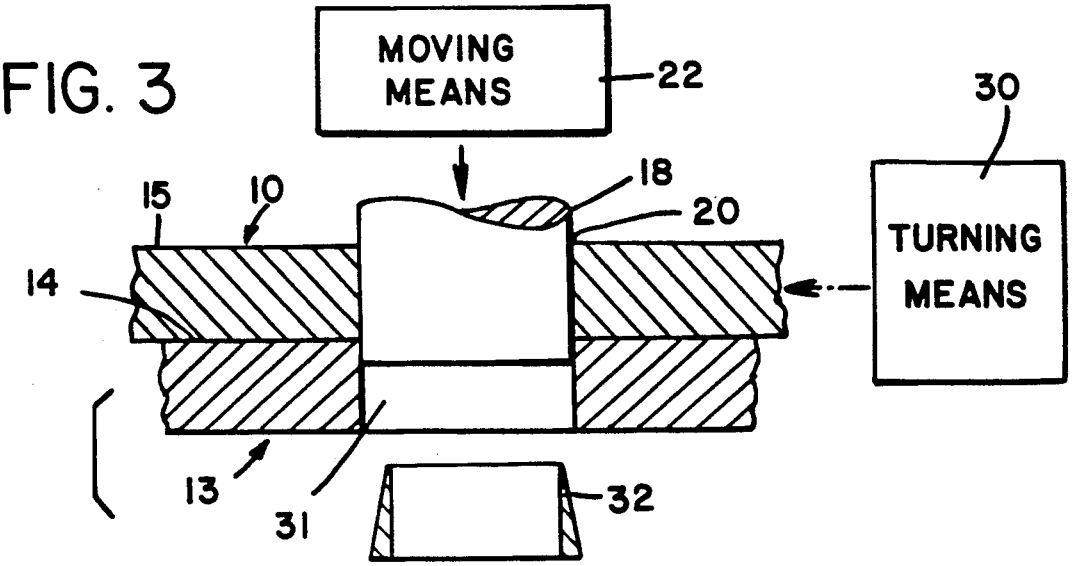
FIG. 3 is schematic diagram similar to that of FIG. 1 but showing the workpiece turned over and the first hole being punched again from a second side thereof with a second punch having a diameter larger than that of the first punch.

In FIG. 3, workpiece 10 is reversed or turned over relative to its placement in FIGS. 1 and 2, i.e., in FIGS. 1 and 2, first side 14 of workpiece 10 is the punching side and faces first punch 17, and in FIG. 3, second side 15 is the punching side and faces second punch 18. Workpiece 10 may be turned over by turning means 30 or manually, and turning means 30 are known to those of skill in the art and therefore are represented by a rectangular block.

Referring to FIG. 3, a second punching operation is carried out on the first hole 26 by the larger diameter second punch 18 and a die 13 having die hole diameter 31 different than that of die 12 used in the first punching operation to produce cross hole 20 of the desired diameter, which is nominally equal to the diameter of second punch 18. The relative diameters of punch 18 and die hole 31 are selected as discussed elsewhere herein. The second punching operation punches a ring 32 of material from the workpiece. The second punching operation again subjects workpiece 10 to a moment generated by the difference in diameters between second punch 18 and die hole 31, which bends workpiece 10 in the opposite direction to the bending produced in the first punching operation, thereby effectively straightening the bent workpiece resulting from the first punching operation.

As mentioned above, punches 17 and 18 have different diameters, and dies 12 and 13 have different hole diameters. The specific punch diameter and die hole diameter are selected as describe above. For example, for a nominal 0.200 inch hole in material of 0.150 inch thickness, the diameter of the first punch 17 may be 0.170 inch, the diameter of the first die hole 24 may be 0.200 inch, the diameter of the second punch 28 may be 0.200 inch and the diameter of the second die hole 31 may be 0.205 inch.

Punching workpiece 10 from opposite sides with a progressively larger diameter punch produces a largely undistorted workpiece, and punching the cross hole with progressively larger diameter punches produces a largely undistorted or straight cross hole.

In the embodiment illustrated in the drawings, workpiece 10 is reversed while moving means 22 and dies 12, 13 remain in their same relative positions. Alternatively, workpiece 10 may be stationary and the positions of moving means 22 and dies 12, 13 may be reversed relative to the workpiece.

A specific embodiment of the invention has been shown and described in detail to illustrate the invention. Certain changes and modifications of the specific embodiment of the invention herein shown and described will be readily apparent to those of skill in the art. It is the Applicant's intention to cover by the claims all those changes and modifications which could be made to the embodiments of the invention herein chosen for the of disclosure which do not depart from the spirit and scope of the invention. Protection by Letters Patent of this invention in all its aspects as the same are set forth in the appended claims is sought to the broadest extent that the prior art allows.

What is claimed is:

1. A method of punching a cross hole of a given diameter in a workpiece, comprising supporting said workpiece and punching a first hole having a diameter less than said given diameter completely through the workpiece from a first side thereof, and supporting said workpiece and punching said first hole again but from a second side of said workpiece opposite said first side at said given diameter to produce said cross hole having said given diameter.

2. The method of claim 1 wherein said workpiece is turned from one of said sides to the other relative to punching apparatus which punches said workpiece after said first hole is punched from said first side, and before said first hole is punched again from said second side.

3. A method of punching a cross hole of a given diameter in a workpiece, comprising punching a first hole having a diameter less than said given diameter completely through the workpiece from a first side thereof using a first punch acting on said first side and a die acting on said second side, and punching said first hole again but from a second side opposite to said first side of said work piece using a second punch acting on said second side and a die acting on said first side to produce said cross hole, said second punch having a diameter greater than that of said first punch and sized to produce said cross hole having said given diameter.

4. The method of claim 3 wherein said workpiece is turned from one of said sides to the other relative to said first punch after said first hole is punched and before said first hole is punched again from said second side.

5. The method of claim 3 wherein dies having different hole sizes are used for punching said first hole from said first and second sides of said workpiece in accordance with the diameter of the punch, whether said hole is being punched or punched again and the thickness of said workpiece.

6. The method of claim 3 comprising selecting: the diameter of said first punch to be somewhat smaller than said given diameter; the diameter of a first hole in a said die to be approximately the same as said given diameter; the diameter of said second punch to be approximately the same diameter as said given diameter; and the diameter of a second hole in a said die to be slightly larger than the diameter of said second punch.

7. Apparatus for punching a cross hole of a given diameter in a workpiece, comprising first means for punching a first hole of a first diameter less than said given diameter completely through said workpiece from a first side thereof, second means for punching said first hole again but at said given diameter from a second side of said workpiece opposite said first side, means for relatively moving said workpiece and said first punching means towards and away from each other and for moving said workpiece and said second punching means towards and away from each other, and means cooperating with said first and second punching means for supporting said workpiece relative to said first and second punching means.

8. The apparatus of claim 7 wherein said first and second punching means comprise first and second punches, respectively, said second punch having a larger diameter than said first punch.

9. The apparatus of claim 8 wherein said supporting means comprises a die.

10. The apparatus of claim 9 wherein said die used for punching from said first and second sides has a hole size selected in accordance with the diameter of said first and second punches, respectively, whether said hole is being punched or punched again and the thickness of said workpiece.

11. The apparatus of claim 9 wherein said first punch has a diameter somewhat smaller than said given diameter; a first hole in a said die cooperating with said first punch having approximately the same diameter as said given diameter; said second punch has approximately the same diameter as said given diameter; and a second hole in a said die cooperating with said second punch has a slightly larger diameter than the diameter of said second punch.

12. The apparatus of claim 7 including means for turning said workpiece from one of said sides to the other relative to said moving means and said supporting means.

13. Apparatus for punching a cross hole of a given diameter in a workpiece, comprising a first punch having a diameter which when said first punch is driven through said workpiece produces a hole of a diameter less than said given diameter, a second punch having a diameter which when said second punch is driven through said workpiece produces a hole of said given diameter, means for supporting said workpiece, means for relatively moving said first punch and said workpiece at a first time to cause said first punch to punch said hole of a lesser diameter completely through said workpiece and for relatively moving said second punch and said workpiece at a second time to cause said second punch to punch said hole of said given diameter in said workpiece, and means for relatively moving said workpiece and said driving means between said first and second times such that opposite sides of said workpiece are punched by said first and said second punches.

14. The apparatus of claim 13 wherein said moving means moves said first punch towards and away from said workpiece to drive said first punch therethrough and then withdraws it at said first time and moves said second punch towards and away from said workpiece to drive said second punch therethrough and then withdraws it at said second time.

15. The apparatus of claim 13 wherein said turning means turns said workpiece.

16. The apparatus of claim 13 wherein said supporting means comprises a die.

17. The apparatus of claim 16 wherein said die used for punching from said first and second sides has a hole size selected in accordance with the diameter of the punch, whether said hole is being punched or punched again and the thickness of said workpiece.

18. The apparatus of claim 16 wherein said first punch has a diameter somewhat smaller than said given diameter; a first hole in a said die cooperating with said first punch has approximately the same diameter as said given diameter; said second punch has approximately the same diameter as said given diameter; and a second hole in a said die cooperating with said second punch has a slightly larger diameter than the diameter of said second punch.

* * * * *

UNITED STATES PATENT AND TRADEMARK OFFICE

CERTIFICATE OF CORRECTION

PATENT NO. : 5,105,696

DATED : April 21, 1992

INVENTOR(S) : Richard C. Baubles

It is certified that error appears in the above-identified patent and that said Letters Patent is hereby corrected as shown below:

Col. 1, line 35: after "tears" insert a period.

Col. 1, line 66: after "thickness" insert a period.

Col. 3, line 64: between "is" and "schematic" insert --a--.

Col. 5, line 9: for "describe" read --described--.

Col. 5, line 35: between "the" and "of" insert --purposes--.

Col. 5, line 64 (Claim 3, line 8): for "work piece" read --workpiece--.

Signed and Sealed this

Twenty-ninth Day of June, 1993

*Attest:*

Michael K. Kirk

MICHAEL K. KIRK

*Attesting Officer*

*Acting Commissioner of Patents and Trademarks*